US009027922B2

(12) United States Patent
Stojanovski et al.

(10) Patent No.: US 9,027,922 B2
(45) Date of Patent: May 12, 2015

(54) SYSTEMS AND METHODS FOR IMPLEMENTING A UNIQUE PLANAR STACKING SURFACE FOR SET COMPILING IN IMAGE FORMING DEVICES

(71) Applicant: XEROX Corporation, Norwalk, CT (US)

(72) Inventors: Billy T. Stojanovski, Penfield, NY (US); Gerald Roy Curry, Lima, NY (US); Thomas Crofton Hatch, Williamson, NY (US); Michael J. Linder, Walworth, NY (US); Todd Maurice Uthman, Rochester, NY (US); Donald R. Fess, Rochester, NY (US)

(73) Assignee: XEROX Corporation, Norwalk, CT (US)

( * ) Notice: Subject to any disclaimer, the term of this patent is extended or adjusted under 35 U.S.C. 154(b) by 60 days.

(21) Appl. No.: 14/053,664

(22) Filed: Oct. 15, 2013

(65) Prior Publication Data

US 2015/0102547 A1 Apr. 16, 2015

(51) Int. Cl.

| | |
|---|---|
| ***B65H 29/34*** | (2006.01) |
| ***B65H 29/42*** | (2006.01) |
| ***B65H 29/22*** | (2006.01) |
| ***B65H 7/02*** | (2006.01) |
| ***B65H 7/20*** | (2006.01) |
| ***B65H 29/50*** | (2006.01) |

(52) U.S. Cl.

CPC ..... *B65H 29/42* (2013.01); *B65H 29/22* (2013.01); *B65H 7/02* (2013.01); *B65H 7/20* (2013.01); *B65H 29/34* (2013.01); *B65H 29/50* (2013.01); *B65H 2301/42261* (2013.01); *B65H 2301/4351* (2013.01); *B65H 2301/4213* (2013.01)

(58) Field of Classification Search

CPC ..... B65H 29/34; B65H 29/42; B65H 29/50; B65H 2301/42261; B65H 2301/4351; B65H 2301/4213

USPC ..... 271/171–179, 189, 306, 221

See application file for complete search history.

(56) References Cited

U.S. PATENT DOCUMENTS

| | | | | |
|---|---|---|---|---|
| 3,280,679 | A * | 10/1966 | Huffman | 83/79 |
| 3,415,351 | A * | 12/1968 | Ware et al. | 198/374 |
| 3,712,487 | A * | 1/1973 | Eberle | 414/795.1 |
| 5,064,185 | A * | 11/1991 | Ricciardi | 271/181 |
| 5,172,909 | A * | 12/1992 | Ricciardi | 271/305 |
| 5,253,859 | A * | 10/1993 | Ricciardi | 271/176 |
| 5,429,349 | A * | 7/1995 | Supron et al. | 271/179 |
| 5,547,182 | A * | 8/1996 | Murphy, III | 271/179 |
| 5,816,570 | A * | 10/1998 | Paradis et al. | 271/179 |
| 6,644,661 | B2 * | 11/2003 | Ikeda | 271/279 |
| 6,984,098 | B2 * | 1/2006 | Tsukahara et al. | 414/794.2 |
| 8,636,280 | B2 * | 1/2014 | Dorrie et al. | 271/179 |

* cited by examiner

*Primary Examiner* — Patrick Cicchino

(74) *Attorney, Agent, or Firm* — Ronald E. Prass, Jr.; Prass LLP

(57) ABSTRACT

A system and method are provided improving stack integrity for a set of image receiving media substrates at an output of a compiler in an image forming device by supplementing a compiler shelf with a pair of augers having a unique planar lead-in for a top surface of the augers. The vertical compiler components reduce a "stepped" configuration of conventional compiler systems to keep a bottom sheet substantially "flat" thereby reducing a tendency for the bottom sheet to disadvantageously shift during in-set alignment processing. The large flat surface at the top of the augers effectively extends the plane of the lead edge shelf. A larger contact area with the sheets/sets of image receiving media substrates, along with the flatter shape of the sets, results in a more stable stack with a lesser tendency of individual sheets to migrate away from a registration edge.

18 Claims, 7 Drawing Sheets

SYSTEMS AND METHODS FOR IMPLEMENTING A UNIQUE PLANAR STACKING SURFACE FOR SET COMPILING IN IMAGE FORMING DEVICES

BACKGROUND

This application is related to U.S. patent application Ser. No. 14/039,045, entitled "Systems and Methods For Implementing An Auger-Based Transport Mechanism For Vertical Transport Of Image Receiving Media In Image Forming Systems," to Herrmann, filed on Sep. 27, 2013, and U.S. patent application Ser. No. 14/053,686, entitled "Systems and Methods For Implementing A Unique Variable Stacking Surface For Set Compiling In Image Forming Devices," filed on Oct. 15, 2013, a same day as this application. The disclosures of the above-identified references are hereby incorporated by reference herein in their entireties.

1. Field of Disclosed Subject Matter

This disclosure relates to systems and methods for improving stack integrity with regard to a set of image receiving media substrates at an output of a compiler (compiler throat) in an image forming device by supplementing a compiler shelf with a pair of augers having a unique planar lead-in for a top surface of the augers.

2. Related Art

Many modern image forming devices are comprised of myriad discrete component sub-systems. These discrete component sub-systems include (1) image receiving media supply components at an input end of the image forming device, (2) pre-processing and/or conditioning components for preparing surfaces of the image receiving media substrates to receive marking material to form images, (3) a marking material delivery component for depositing marking material on the surfaces of the image receiving media substrates to form the images according to input or read image signals, (4) fusing/finishing components for fixing the deposited marking material on the image receiving media substrates, and (5) post-processing devices for carrying out certain post processing tasks including compilers for collating the image receiving media substrates as sets comprising multi-page finished documents, for example, for stapling or otherwise binding the multi-page finished documents.

The individual component sub-systems are generally interconnected by a series of increasingly intricate image receiving media substrate transport sub-systems, paths and/or components. The image receiving media transport sub-systems, paths and/or components are generally designed and implemented in particular office-sized image forming devices in a manner that manages a size footprint for the image forming devices while not specifically limiting the transport requirements from an output of one component sub-system to an input of another component sub-system.

At an end of the processing scheme, the form and function of the image receiving media transport sub-systems, paths and/or components often become somewhat more narrowly defined. The print job is generally completed with individual sheets of image receiving media substrate, with the images formed and fixed thereon, being collected in sets at a compiler tray that may be associated with one or more of the post-processing sub-systems. Manipulation of the individual image receiving media substrates, or of the sets of image receiving media substrates, at that point in the processing of the documents responsive to the directed print job can be particularly intricate. There is often a need to ensure that the sets of image receiving media substrates are fairly precisely handled, stacked, and/or registered in order to facilitate one or more pot-processing or finishing processes including, for example, stapling or binding.

The manipulations associated with aligning (registering) individual sheets into sets are broadly referred to as, and are generally understood by those of skill in the art to involve, functions of stacking and tamping the individual sheets of image receiving media substrates into precise alignment in the sets. Stacking often occurs against a static edge alignment body portion at an output of the processing or post-processing devices to provide longitudinal alignment of the individual sheets of image receiving media substrates with respect to a process direction, stacking being generally considered to be a passive process. Tamping generally refers to a most often active alignment component in which paddles or other devices may be employed on any, but most often, lateral sides of a set of image receiving media substrates to align the set in a direction orthogonal to the process direction.

Certain currently-fielded systems may be configured with what may generally be described as vertical compiler subsystems. FIG. 1 illustrates a simple schematic representation of a side view of an exemplary system 100 incorporating a commonly-implemented vertical compiler. FIG. 2 illustrates a simple schematic representation of a top plan view of an exemplary system 100 incorporating the same commonly-implemented vertical compile shown in FIG. 1. As shown in FIGS. 1 and 2, individual sheets of image receiving media substrate 130 exit an imaging system processing/post-processing device 110 at an exit/ejection port 115 and are individually deposited in an output (compiler) tray 120.

A "bottom" or platform of the output (compiler) tray 120 may consist of a plurality of longitudinally-arranged image receiving media substrate supports that extend in the process (longitudinal) direction of the image receiving media substrate 130. The image receiving media substrate 130 rests on the substrate supports and is generally manually recoverable from the substrate supports.

In exemplary systems such as that shown in FIGS. 1 and 2, vertical set compiling may occur in one or more stages as follows. Individual image receiving medium substrate(s) 130 may be dropped in stages from the output (compiler) tray 120, acting as a temporary compiler. This dropping may be effected, by laterally-opposing motions, i.e., orthogonal to the process direction, of the plurality of longitudinal image receiving media substrate supports (or arms) toward opposed lateral edges of the output (compiler) tray 120, displacing the substrate supports from under the image receiving media substrate 130. As a result of the linear movement of the plurality of longitudinal image receiving media substrate supports, each of the image receiving media substrates 130 drops down to an image receiving medium set receiving platform, or an output set collection platform component 150.

The image receiving media substrates 130 may be collected as a set 140 on the output set collection platform component 150. The output set collection platform component 150 may be, in turn, comprised of at least a pair of compiler shutters 152/154. Each sheet of image receiving media substrates 130 in the set is dropped in a similar fashion to create the set 140 of image receiving media substrates on the compiler shutters 152/154. When the set 140 of image receiving media substrates is complete and properly registered, and optionally, for example, bound or stapled, the set 140 of image receiving media substrates is then dropped onto a stack of previously-dropped sets 170 of image receiving media substrates, or directly onto some manner of set output transport path 160 to be moved in a process direction B from a first stack position to a second stack position 180 and beyond.

The above-described dropping function is currently undertaken in commonly-implemented vertical compiler sub-systems by rapid cycling of the compiler shutters 152/154 in opening and then closing in mechanically opposing motions.

SUMMARY OF THE DISCLOSED EMBODIMENTS

Both of the above-described drop functions will often tend to introduce variation in set registration in the first individual sheet drop stage and the set-to-set (stack) registration in the second drop stage. U.S. patent application Ser. No. 14/039,045, entitled "Systems and Methods For Implementing An Auger-Based Transport Mechanism For Vertical Transport Of Image Receiving Media In Image Forming Systems," to Herrmann, the disclosure of which is hereby incorporated by reference herein in its entirety describes an auger-based vertical transport system for uniquely addressing shortfalls in conventional vertical transport components.

In certain currently-fielded image forming devices and image forming systems, particularly for use in an office environment, internal vertical compilers often suffer some measure of compromise with regard to internally compiled set integrity that is associated with a conventional compiler tray configuration. In such configurations, a trail edge of individual image receiving media substrates being compiled as a set rests nominally in a range of 7-30 mm below a lead edge in the compiler throat. A disadvantageous result of this configuration then is that, when side tamping is applied to a compiled set image receiving media substrate, bottom sheets are often caused to "walk back." This walk back further results in poor in-set registration in a process direction. Additionally, as small stapled sets (<20 sheets) of image receiving media substrates build-up on an accumulated stack of sets below, the increased thickness due to the stapling can eventually build to a point where the stack interferes with the compiling sets, causing further height differential and exacerbating the problem.

Previous methods that have been applied to attempt to address and alleviate compiler congestion issues resulting from the above-described differential stacking heights have included the use of compiler shutters as generally described above on a basic finisher module (BFM). A difficulty with these currently-attempted "solutions" is that operating and processing speeds for completing print jobs in the involved image forming devices continue to increase. The demands for precision in registration and alignment of sets of documents remain very high. This combination of factors places ever increasing stress on conventional systems causing mechanical components to fail. Also, as reciprocating mechanical components, including compiler shutters, are caused to move at increased speeds, disturbances may be introduced that may adversely affect the efforts to precisely align the stacks of image receiving media substrates comprising each set. Abrupt movements of the shutters, for example, may cause the image receiving media substrates to be displaced slightly with the movement of the shutters. Additionally, rapid reciprocating movements may introduce airflows at relatively higher velocities that may cause the individual image receiving media substrates to be fluffed, fluttered and skewed in a random manner. These functional difficulties may increase demands placed on longitudinal (trailing edge) and lateral (side) tampers as these components are, in turn, called upon to routinely react more rapidly to correct increasingly frequent and extensive alignment errors. The conventional shutter-based configurations are considered not to be able to work effectively in certain devices due to productions speeds, e.g., at upwards to 157 ppm.

It would be advantageous in view of the above-noted image receiving medium handling difficulties arising from increasingly high speed document preparation requirements and the significantly increased mechanical stresses placed on linearly reciprocating components to find some manner by which to optimize movement of vertically moved image receiving media substrates and sets of image receiving media substrates in a manner that reduces and/or slows overall movement, and particularly high speed reciprocating movement, of certain components in the vertically-configured image receiving media transport paths. It would be further advantageous to implement innovations in vertical compiler components and/or sub-systems that may reduce the "stepped" configuration of current compiler systems in a manner that keeps a bottom sheet of image receiving medium substrate substantially "flat," thereby reducing a tendency for the bottom sheet to disadvantageously shift during in-set alignment processing. In currently-fielded conventional systems, approximately 43 mm of a lead edge of sheets if image receiving media substrates are supported by the compiler shelf and the rest is not.

Exemplary embodiments of the systems and methods according to this disclosure may provide additional structures to facilitate vertical movement of individual substrates and sets of substrates in a compiler section that are particularly configured to support a remaining (currently-unsupported) length of the sheets being compiled.

Exemplary embodiments may provide additional support structures in a form of a pair of augers configured with a unique planar lead-in for top surfaces of the pair of augers.

Exemplary embodiments may provide the pair of particularly-configured augers to both support the sheets of image receiving media during compiling as a completed set, and to serve as a controlled transport system for lowering the finished sets onto the main internal tray.

Exemplary embodiments may refine and specifically employ particular configurations of other related auger support/transport systems to a particular configuration and function. Auger systems, such as those described and depicted in the related 045 application, employ traditional helical auger shapes. A spiral surface of the related augers may engage different width sheets at different points along the blades of the augers, and may include configurations that allow for downward sag toward the center of the sheets of image receiving media substrates along their length. In embodiments, the disclosed concept modifies those configurations to particularly add a large flat surface that may advantageously be aligned in a manner to be substantially co-planar with a top of a compiler shelf. In embodiments, the large flat surface at the top of the pair of augers may be situated in a manner to effectively extend the plane of the lead edge shelf with an objective of, among others, aiding in keeping flat a bottom sheet of image receiving medium substrate, as well as an entire set being compiled. A larger contact area with the sheets/sets of image receiving media substrates, along with the flatter shape of the sets, may result in a more stable stack with a lesser tendency of individual sheets to migrate away from a registration edge.

These and other features, and advantages, of the disclosed systems and methods are described in, or apparent from, the following detailed description of various exemplary embodiments.

BRIEF DESCRIPTION OF THE DRAWINGS

Various exemplary embodiments of the disclosed systems and methods for improving stack integrity with regard to a set of image receiving media substrates at an output of a compiler (compiler throat) in an image forming device by supplementing a compiler shelf with a pair of augers having a unique planar lead-in for a top surface of the augers, will be described, in detail, with reference to the following drawings, in which.

DETAILED DESCRIPTION OF THE DISCLOSED EMBODIMENTS

Figure 1:
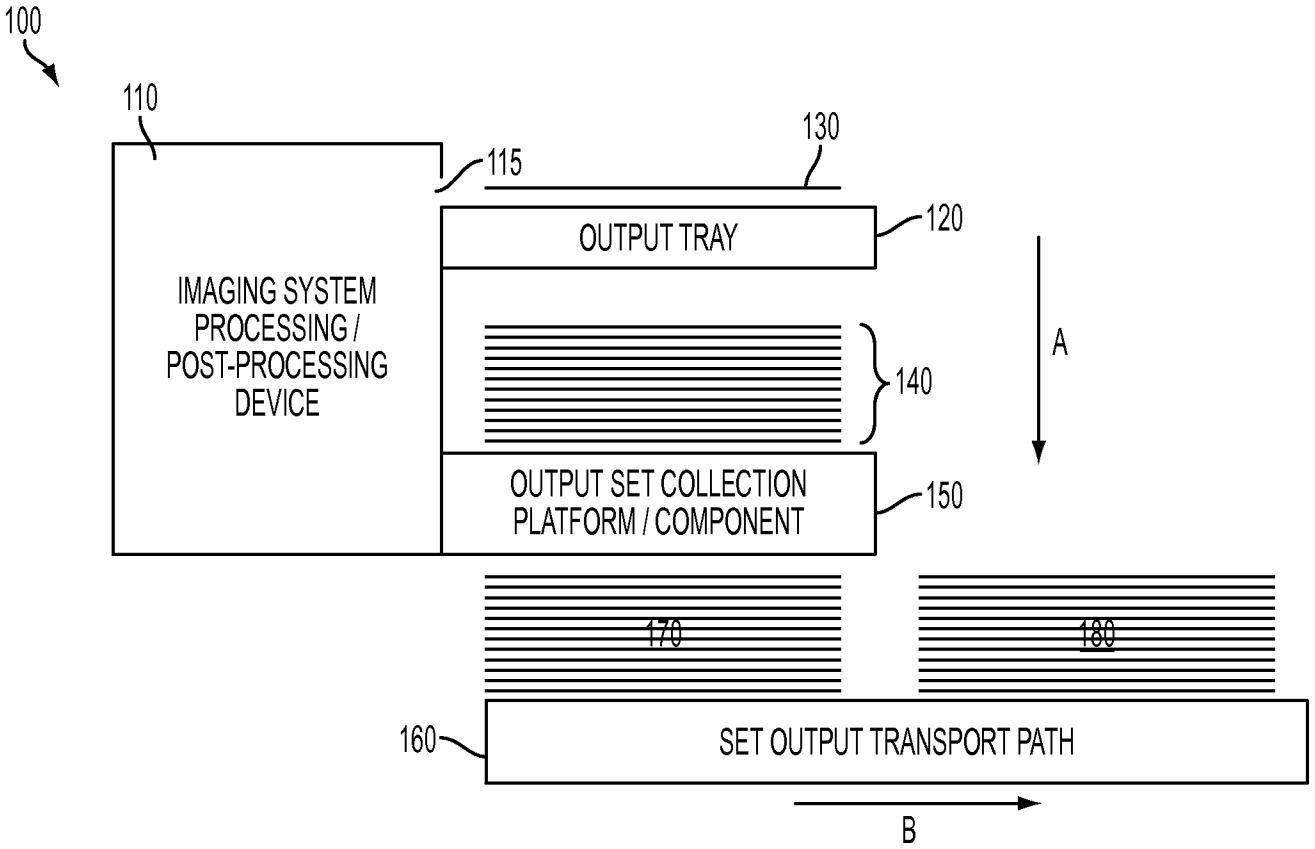
FIG. 1 RELATED ART
FIG. 1 illustrates a simple schematic representation of a side view of an exemplary related art system incorporating a commonly-implemented vertical compiler setup that may be improved upon using the systems and methods according to this disclosure.
Figure 2:
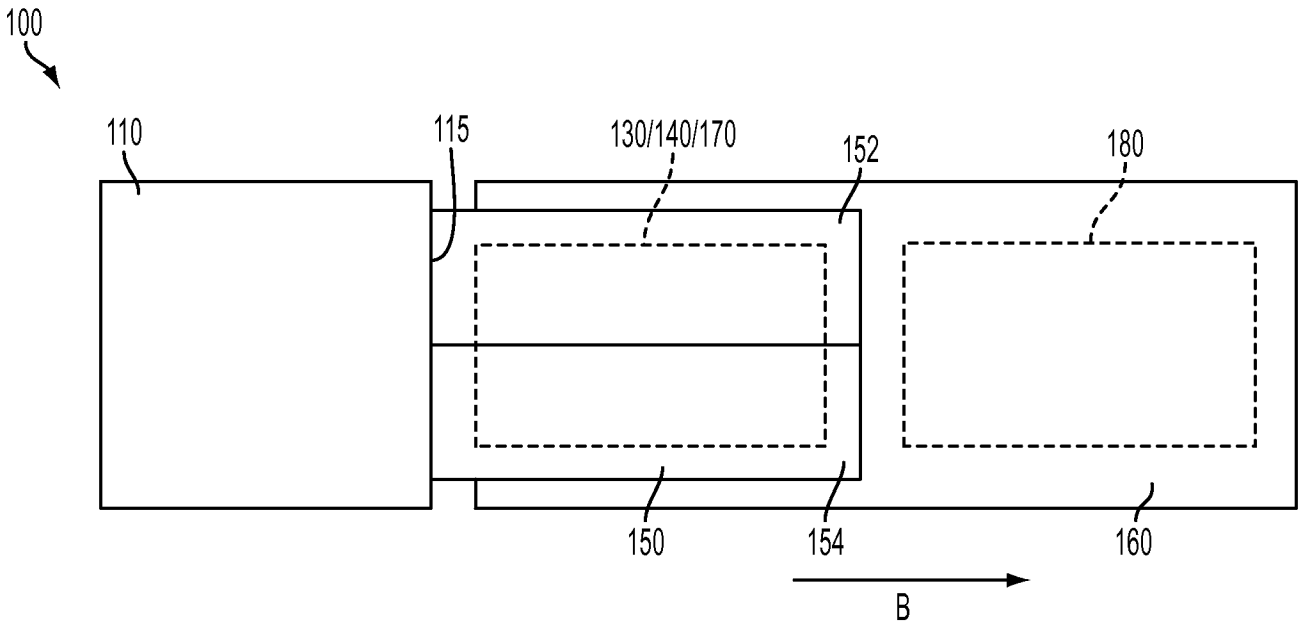
FIG. 2 RELATED ART
FIG. 2 illustrates a simple schematic representation of a top plan view of the exemplary related art system incorporating the same commonly-implemented vertical compiler setup shown in FIG. 1.

The systems and methods for improving stack integrity with regard to a set of image receiving media substrates at an output of a compiler (compiler throat) in an image forming device by supplementing a compiler shelf with a pair of augers having a unique planar lead-in for a top surface of the augers according to this disclosure, will generally refer to this specific utility, configuration or function for those systems and methods. Exemplary embodiments described and depicted in this disclosure should not be interpreted as being specifically limited to any particular configuration of the described elements except insofar as individual auger elements as disclosed and depicted will provide flat "top" surfaces, or as being specifically directed to any particular intended use, including any particular functioning or operation of a processing, post-processing or other component device in an image forming system in which elements of the disclosed auger-based transport system or mechanical auger vertical compiler device may be advantageously employed.

Specific reference to, for example, various configurations of image forming systems and component devices within those systems, including post-processors and/or compilers, as those concepts and related terms are captured and used throughout this disclosure, should not be considered as limiting those concepts or terms to any particular configuration of the respective devices, the system configurations or the individual elements. The subject matter of this disclosure is intended to broadly encompass systems, devices, schemes and elements that may involve image forming and finishing operations, as those operations would be familiar to those of skill in the art. The disclosed concepts are particularly adapted to providing one or more auger-based vertical compiler systems in appropriate image receiving media transport paths between individual component devices associated with image forming and finishing in a complex image forming system.

The disclosed embodiments may specifically address shortfalls in conventional compilers in which compiled stack integrity is often compromised because the trailing edges of image receiving media substrates rest at some measurable distances below the leading edges in the compiler throat. Stacking and registration processes, including side tamping of the stack, in conventional devices disadvantageously cause lower sheets to migrate, or to "walk back," leading to errors in in-set registration in the process direction. Other errors are introduced as well in that, for example, as small stapled sets (<20 sheets) build up on a stack below, increased localized thicknesses due to stapling eventually build to a point where the stack can interfere with the compiling sets, causing further height differential and exacerbating the problem. For the reasons discussed above, earlier methods to mitigate these issues were of limited effectiveness for stated reasons, including being comprised of structures that may impose physical limits on page per minute throughput for the systems.

The disclosed embodiments may reduce or substantially eliminate uneven support for sheets in a first stage of a two stage compiler sub-system to aid in reducing a tendency of lower sheets to migrate in a registration process, thereby thwarting the intent of the registration process requiring additional mechanical movements rather than fewer. In embodiments, a substantially entire length of the image receiving media substrate sheets being compiled is supported. In addition to a substantial length being supported on a conventional compiler tray, additional previously-unsupported lengths may now be supported on a pair of auger top surfaces. The auger top surfaces are configured to have what will be consistently referred to as a unique planar lead-in, which differentiates these augers from others that may be similarly disposed. In operation, as will be particularly shown below with reference to FIGS. 3-6, the augers would both support the sheets of image receiving media substrate during compiling, and serve to effect a vertical transport of the compiled sets to deliver, for example, finished sets onto a main internal tray for further processing or output.

The disclosed augers advantageously modify a conventionally-known auger configuration by adding a large flat surface to the top of each of the augers, the large flat surfaces are advantageously placed parallel to and co-planar with a top of the compiler shelf. The disclosed large flat surfaces at the tops of the augers may effectively extend a plane of the leading edge shelf, helping to keep flat the lower sheets of image receiving media as they are compiled, thereby more effectively supporting the entire set being compiled. The larger contact area with the sheets of image receiving media substrates, along with the flatter shape of the set, may result in a more stable stack with a lesser tendency of the sheets to migrate away from the registration edge.

Figure 3:
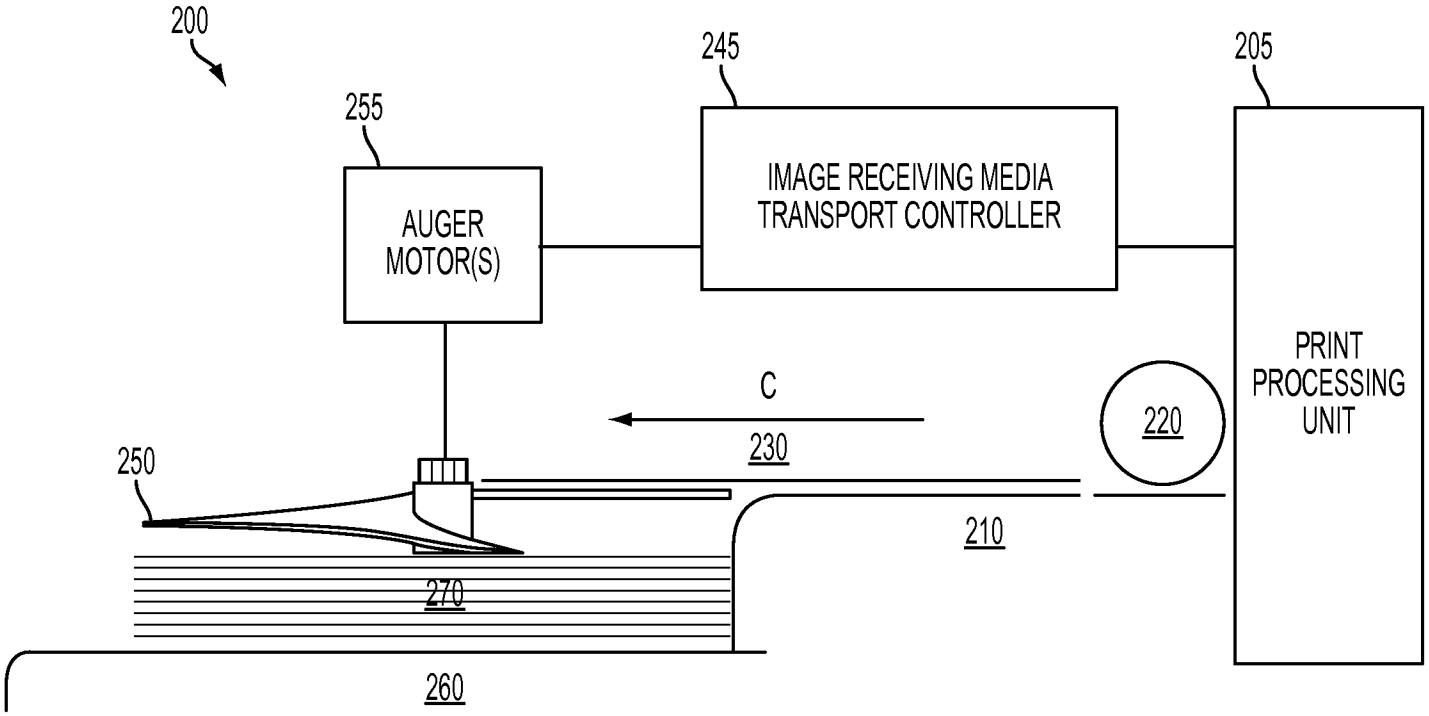
FIG. 3 illustrates a schematic diagram of a side view of an exemplary image receiving media processing and transport system incorporating a particularly-configured auger-based vertical compiler including a pair of planar-topped augers executing a first functional step according to this disclosure.
Figure 4:
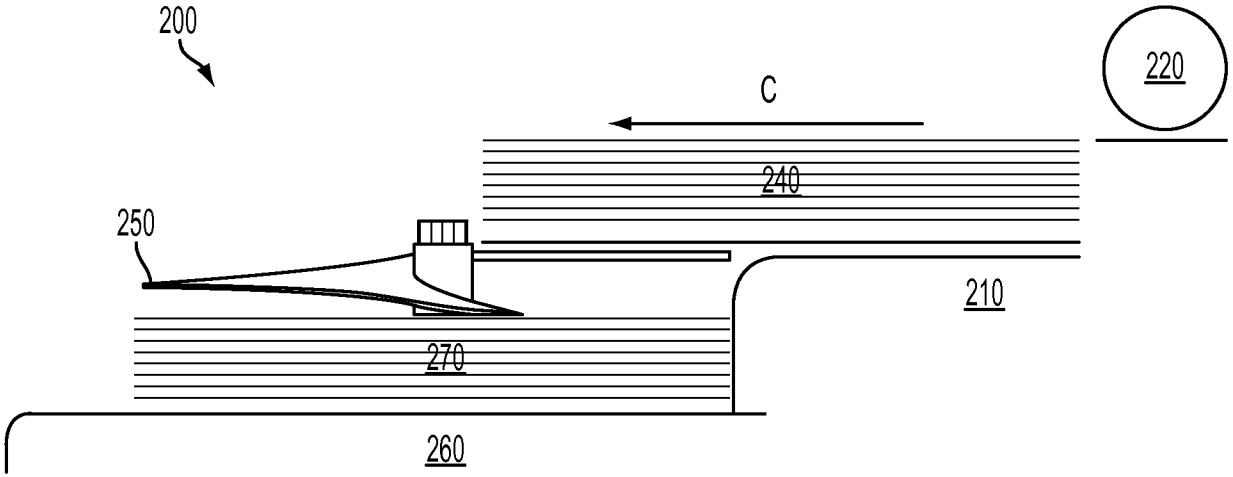
FIG. 4 illustrates a schematic diagram of a side view of the exemplary image receiving media processing and transport system of FIG. 3 (with some detail removed for clarity) executing a second functional step according to this disclosure.
Figure 5:
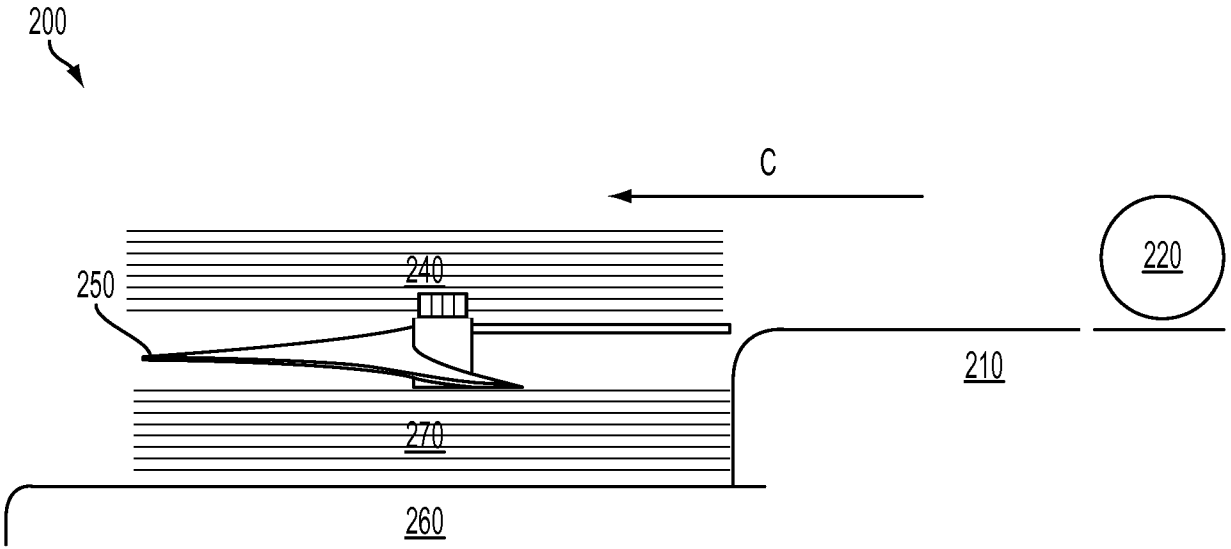
FIG. 5 illustrates a schematic diagram of a side view of the exemplary image receiving media processing and transport system of FIG. 3 (with some detail removed for clarity) executing a third functional step according to this disclosure.
Figure 6:
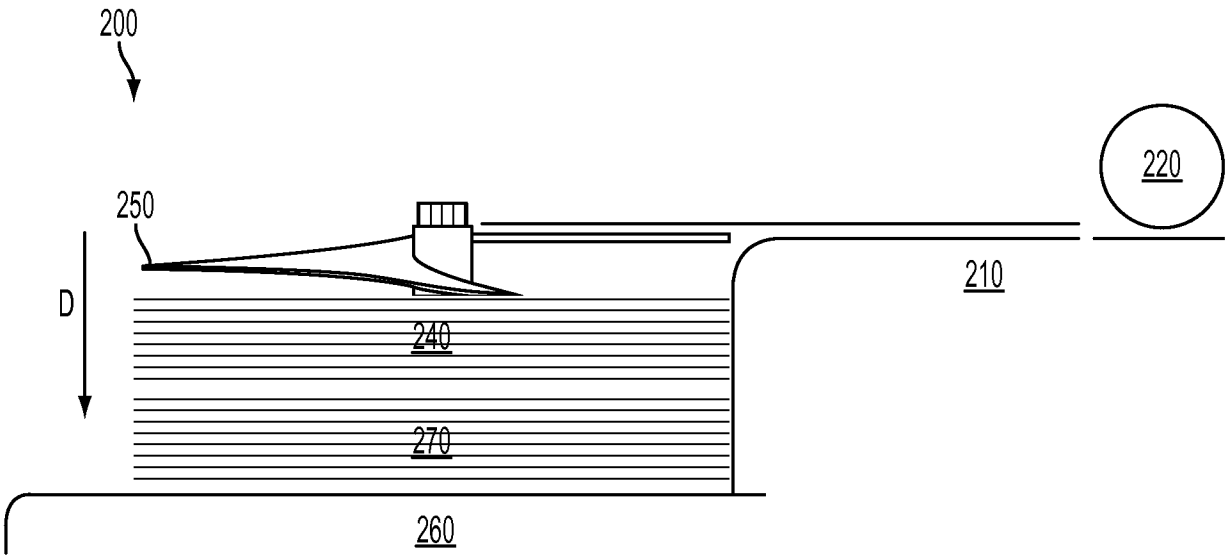
FIG. 6 illustrates a schematic diagram of a side view of the exemplary image receiving media processing and transport system of FIG. 3 (with some detail removed for clarity) executing a fourth functional step according to this disclosure.

FIG. 3 illustrates a schematic diagram of a side view of an exemplary image receiving media processing and transport system 200 incorporating a particularly-configured auger-based vertical compiler including a pair of planar-topped augers executing a first functional step according to this disclosure. FIGS. 4-6 illustrate schematic diagrams of a similar side view of the exemplary image receiving media processing and transport system 200 of FIG. 3 (with some detail removed for clarity) executing second, third and fourth functional steps according to this disclosure. As shown in FIG. 3, the exemplary system 200 may include one or more scuffers 220 that are generally arranged according to known methods to aid in the translation of an image receiving media substrate 230 from an ejector port or other similar opening in a print processing unit 205. The generic print processing unit 205 shown in FIG. 3 is intended to represent, as appropriate, any one or more of a pre-conditioning device, marking module, post-processing device and/or other individual image receiving media substrate processing component, as may be associated with an image forming process in an image forming device or system. The scuffer 220 may be configured to induce movement of the image receiving media substrate 230 in the direction C, until the image receiving media substrate is clear of the ejector port or other similar opening in the print processing unit 205. At the completion of the movement of the image receiving media substrate 230 induced by the scuffer 220, the image receiving media substrate 230 may be partially supported by a compiler tray 210 and a planar top surface of a particularly-configured pair of auger components 250.

The auger components 250 may be formed of suitable materials including plastics and/or polycarbonates, and may include sleeve bearings at their ends, which may preferably be formed of bronze material. Pulley grooves, shown as vertical lines in the top of the depiction of the auger components 250 in FIG. 3, may be molded into one end of a spindle of the auger components 250 for engagement with, for example, one or more timing belts. Each of the particularly-configured auger components 250 may be mounted on a stainless pin attached to a sheet metal arm. A single auger motor 255, including a stepper motor, may be used to drive both of the pair of auger components simultaneously. Otherwise in embodiments, multiple auger motors 255 may be used. Regardless of whether a single auger motor 255 or multiple auger motors are used, operation of the auger motor(s) 255 may be under control of an image receiving media transport controller 245 that may be used to control one or more of the linear motion induced by the scuffer 220, and all aspects of image receiving media substrate set handling by the auger components 250, as may be described in further detail below. For reference, a completed and previously vertically delivered set 270 of image receiving media substrates comprising a complete print document is shown having been delivered and arranged on a main internal set processing tray 260.

Sheet transport from the print processing unit 205 may be effected as each sheet of image receiving media substrate 230 may be caused to enter a compile area of the print processing unit 205 via, for example, a vacuum or other transport mechanism. As a leading edge of the first sheet of image receiving media substrate 230 reaches the scuffer unit 220, the first sheet of image receiving media substrate 230 may be pulled toward a registration edge. Where applicable, the vacuum may be turned off and the remaining length of the sheet of image receiving media substrate 230 may be translated across compiler tray 210 in direction C with some portion of the image receiving media substrate 230 falling onto the pair of auger components 250 for additional support.

Moving to the detail shown in FIG. 4, second and subsequent sheets of image receiving media substrates may, in turn, be caused to engage the scuffer 220 and be pulled forward to be registered in the forming of the set 240 of image receiving media substrates that will comprise a complete set. In embodiments, the auger components 250 may be caused to rotate a slight amount, in counter-rotating directions, preferably inward urging the lower-most sheets of image receiving media substrates back toward a registration wall (not shown), thereby substantially overcoming certain mis-registration errors, including those arising from the commonly understood phenomena of bounce-back, or other disadvantageous movement that may have been experienced by this first sheet of image receiving media substrate. The flat top surfaces on each of the auger components 250 may allow for this small rotation to occur without affecting the planar attitude or vertical position of the compiling or accumulating set 240 of image receiving media substrates.

Moving to the detail shown in FIG. 5, once a set 240 of image receiving media substrates is completed, the auger components 250 may be rotated through forces exerted on the auger components 250 by the one or more auger motors 255 shown in FIG. 3. This motion of the auger components 250 may serve to translate the set 240 of image receiving media substrates in direction C from the position shown in FIG. 4 to that shown in FIG. 5, in which the set 240 of image receiving media substrates is substantially completely supported by the auger components 250.

Rotation of the auger components 250 may continue in a manner that effects vertical movement of the set 240 of image receiving media substrates in direction D (see FIG. 6) from the position shown in FIG. 5, to a position such as that shown in FIG. 6 in which the most recently collected set 240 of image receiving media substrates may be deposited on an already positioned set 270 of image receiving media substrates, or may otherwise be deposited directly on an empty main internal set processing tray 260. It should be recognized that, as the flat area revolves out from under the set 240 of image receiving media substrates, the helical portion of the auger components 250 will come into play to effect the vertical movement of the set 240 of image receiving media substrates in direction D. As the auger components 250 continue to rotate, the top flat portions will pass over the top of the descending set 240 of image receiving media substrates thereby providing an almost compartmentalized handling of each respective set of image receiving media substrates handled by the auger components 250 in affecting vertical translation of each respective set of image receiving media substrates between a position on the top flat portions of the auger components 250 and an output position from the auger components 250 in which the respective sets of image receiving media substrates may be sequentially deposited on the main internal set processing tray 260, to facilitate, for example, removal or, depending on a configuration, further transport from the main internal set processing tray 260 by additional lateral transport components to support further processing and/or output of the respective sets of image receiving media substrates in the image forming device or system with which the exemplary image receiving media processing and transport system 200, as shown in FIGS. 3-6, may be associated.

Among the objectives achieved by the disclosed configurations may be a unique advantage in that sheets of image receiving media substrates are supported at multiple points in a single plane, keeping the collected sets of image receiving media substrates comparatively flat during the collecting and compiling operations. A tendency of sheets of image receiving media substrates to migrate away from a registration wall or other alignment component, due to any slope being caused by the presence of, for example, stepped surfaces, may be substantially eliminated.

It should be noted that the image receiving media transport controller 245 may be a stand-alone component, or may be a part or function of another processor or controller logic device in the image forming device or system with which the exemplary image receiving media processing and transport system 200 may be associated. The image receiving media transport controller 245 may, for example, receive input signals as a print job is processed in the image forming system to determine when and how much to rotate the auger components 250 at different stages in the depicted image receiving media transport process to complete the overall image forming process in the image forming system with which the exemplary image receiving media processing and transport system 200 may be associated.

A vertical profile for the pitch of the auger components 250 downward from the planar top surfaces may not be particularly limited. The vertical profile for the pitch may be configured to accommodate individual sets 240 of image receiving media substrates up to a particular maximum number of sheets or overall set thickness.

The above-described well-controlled lateral and vertical transport movements of individual image receiving media substrates and compiled sets of image receiving media substrates including vertical translation of the compiled sets of image receiving media substrates by the auger components 250 of the depicted exemplary image receiving media processing and transport system 200 may aid in substantially reducing, and potentially eliminating, variations in in-set registration in the compiler. The disclosed systems seek to substantially preclude the registration variability incumbent in conventional compiler techniques. Positive control over both the support and transport movement of individual image receiving media substrates and compiled sets of image receiving media substrates aid in overcoming recognized shortfalls in conventional systems.

Figure 7:
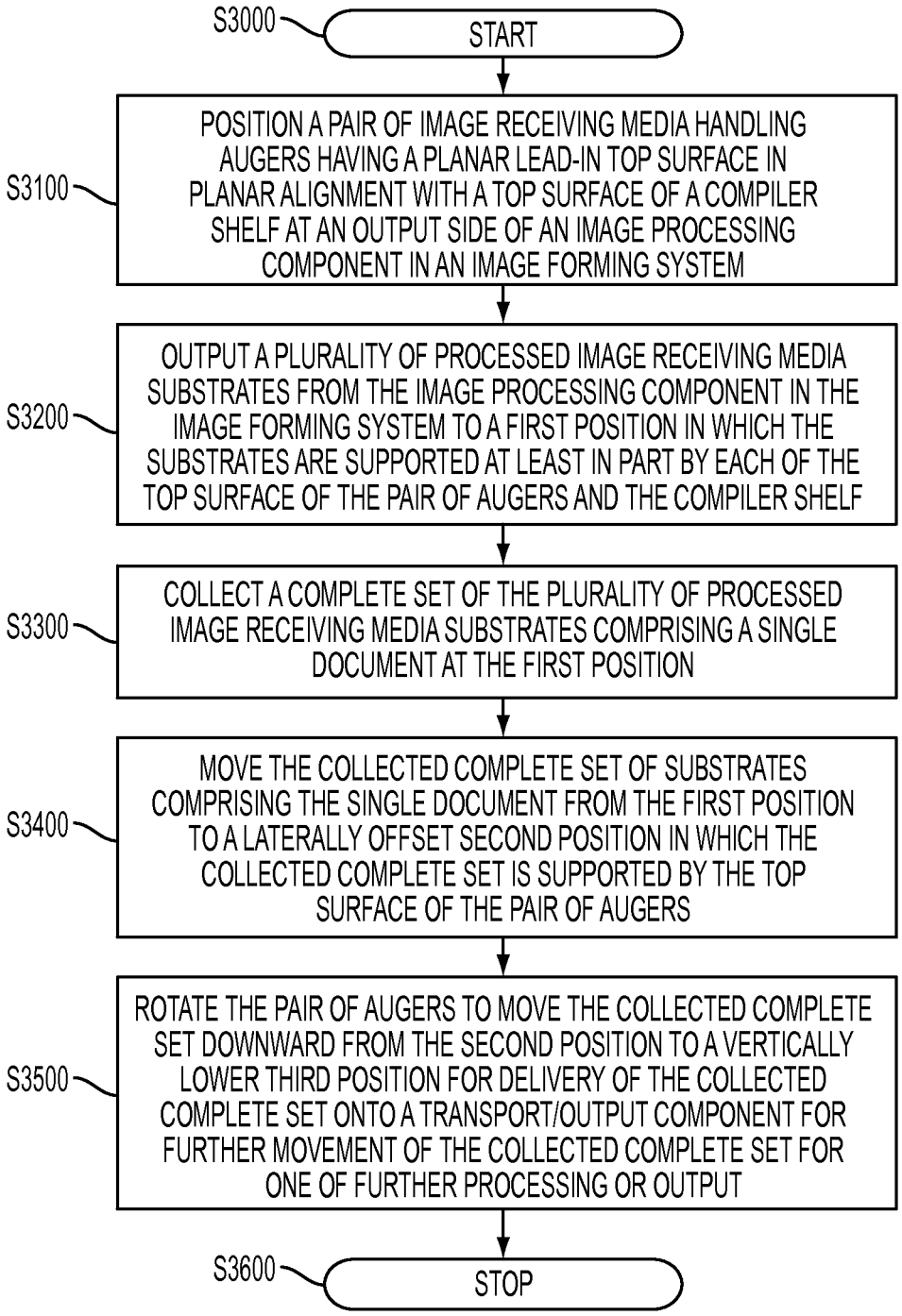
FIG. 7 illustrates a flowchart of an exemplary method for implementing a process for image receiving media transport sets in a particularly-configured auger-based vertical compiler sub-system according to this disclosure.

The disclosed embodiments may include a method for implementing a process for image receiving media transport of sets in a particularly-configured auger-based vertical compiler system. FIG. 7 illustrates a flowchart of such an exemplary method. As shown in FIG. 7, operation of the method commences at Step S3000 and proceeds to Step S3100.

In Step S3100, a pair of image receiving media handling auger components, each having a planar lead-in top surface, may be provided and/or arranged in substantially co-planar alignment with a top surface of a conventional compiler shelf. The compiler shelf may be positioned at an output side of an image processing or post-processing component or sub-system in the image forming system. The pair of image receiving media handling auger components having the planar lead-in top surfaces may generally be arranged downstream of the compiler shelf in a process direction. Operation of the method proceeds to Step S3200.

In Step S3200, a plurality of processed image receiving media substrates may be output in order from the image processing or post-processing component or sub-system in the image forming system to a first position in which the image receiving media substrates are supported at least in part by each of the top surfaces of the pair of augers and the compiler shelf. Operation of the method proceeds to Step S3300.

In Step S3300, a complete set of the plurality of processed image receiving media substrates comprising a single document, according to a single print job assignment in the image forming system, may be collected at the first position in the image transport path for the image receiving media substrates. Operation of the method proceeds to Step S3400.

In Step S3400, a signal may be received via, for example, an image receiving media transport controller to move the collected complete set of substrates comprising the single document from the first position to a laterally offset second position in which the collected complete set of image receiving media substrates is supported by the flat top surfaces of the pair of auger components. Operation of the method proceeds to Step S3500.

In Step S3500, another signal may be received via the image receiving media transport controller to cause the auger motor(s) to rotate the auger components to move the collected complete set of image receiving media substrates comprising the single document vertically downward from the second position to a vertically lower third position for delivery of the collected complete set of image receiving media substrates onto a transport/output component for further movement of the collected complete set of image receiving media substrates for one or more of further processing or output. Operation of the method proceeds to Step S3600, where operation of the method ceases.

The above-described exemplary systems and methods reference certain conventional components to provide a brief, general description of suitable document processing and post-processing means by which to carry out the disclosed image receiving media transport techniques in support of obtained image forming operations in the described image forming devices and systems. Those skilled in the art will appreciate that other embodiments of the disclosed subject matter may be practiced with many types and configurations of individual devices and combinations of devices particularly common to image forming and post-processing of image formed products in image forming devices and systems of varying complexity. No particular limitation to the variety or configuration of individual component devices included in image forming systems of varying complexity is to be inferred from the above description.

The exemplary depicted sequence of executable instructions represents one example of a corresponding sequence of acts for implementing the functions described in the steps. The exemplary depicted steps may be executed in any reasonable order to carry into effect the objectives of the disclosed embodiments. No particular order to the disclosed steps of the method is necessarily implied by the depiction in FIG. 7, and the accompanying description, except where a particular method step is a necessary pre-condition to execution of any other method step. Individual method steps may be carried out in sequence or in parallel in simultaneous or near simultaneous timing, as appropriate.

Although the above description may contain specific details, they should not be construed as limiting the claims in any way. Other configurations of the described embodiments of the disclosed systems and methods are part of the scope of this disclosure.

It will be appreciated that a variety of the above-disclosed and other features and functions, or alternatives thereof, may be desirably combined into many other different systems or applications. Various alternatives, modifications, variations, or improvements therein may be subsequently made by those skilled in the art, which are also intended to be encompassed by the following claims.

We claim:

1. A method for handling image receiving media substrates in an image forming system, comprising:

providing a compiler tray at an output of an image receiving media substrate processing device as a first portion of a transport mechanism for collecting a set of processed image receiving media substrates exiting the output of the image receiving media substrate processing device;

providing a vertical compiler unit downstream of the compiler tray in a process direction as a second portion of the transport mechanism for moving collected sets of processed image receiving media substrates from the compiler tray, the vertical compiler unit comprising:

a pair of auger components as transport mechanisms in the vertical compiler unit, each of the pair of auger components having a planar top surface that is substantially parallel to, and positioned substantially coplanar with, the a substrate collection surface of the compiler tray, and at least one auger motor for driving the pair of auger components in a coordinated manner about respective vertical auger component shafts for the pair of auger components;

providing an image receiving media substrate transport controller that controls movement of the transport of the image receiving media substrates exiting the output of the image receiving media substrate processing device including controlling operation of the at least one auger motor; and collecting the set of processed image receiving media substrates in a first position in which the set of processed image receiving media substrates are supported partially by the compiler tray and partially on the planar top surfaces of the pair of auger components.

2. The method of claim 1, further comprising operating the pair of auger components to urge lowermost processed image receiving media substrates in a direction opposite to the process direction facilitating alignment of the collected set of processed image receiving media substrates against an alignment surface associated with the image receiving media substrate processing device.

3. The method of claim 1, further comprising operating the pair of auger components to transport the collected set of processed image receiving media substrates from the first position to a second position in which the set of processed image receiving media substrates is substantially entirely supported on the planar top surfaces of the pair of auger components.

4. The method of claim 3, further comprising operating the pair of auger components to transport the collected set of processed image receiving media substrates from the second position to a third position in which the set of processed image receiving media substrates are transported vertically downward in the vertical compiler unit.

5. The method of claim 3, further comprising:

receiving, with the image receiving media substrate transport controller, signals regarding image processing in the image receiving media substrate processing device indicating completion of the set of processed image receiving media substrates collected in the compiler tray; and causing, with the image receiving media substrate transport controller, the at least one auger motor to operate to move the set of processed image receiving media substrates from the first position to the second position.

6. The method of claim 4, further comprising causing, with the image receiving media substrate transport controller, the at least one auger motor to operate to move the set of processed image receiving media substrates from the second position to the third position lower in the vertical compiler unit leaving the planar top surfaces of the auger components open to receive another set of processed image receiving media substrates in the first position.

7. The method of claim 4, the third position being an exit position from the vertical compiler unit, the method further comprising depositing the set of processed image receiving media substrates on an internal media handling tray in a vicinity of the exit position from the vertical compiler unit.

8. The method of claim 1, the pair of auger components being rotated by the at least one auger motor in opposing counter-rotating directions.

9. An image receiving media transport device, comprising:

a compiler tray positioned at an output of an image receiving media substrate processing device as a first portion of a transport mechanism for collecting a set of processed image receiving media substrates exiting the output of the image receiving media substrate processing device;

a vertical compiler unit downstream of the compiler tray in a process direction as a second portion of the transport mechanism for moving collected sets of processed image receiving media substrates from the compiler tray, the vertical compiler unit comprising:

a pair of auger components as transport mechanisms in the vertical compiler unit, each of the pair of auger components having a planar top surface that is substantially parallel to, and positioned substantially coplanar with, the a substrate collection surface of the compiler tray, and at least one auger motor for driving the pair of auger components in a coordinated manner about respective vertical auger component shafts for the pair of auger components; and an image receiving media substrate transport controller that controls movement of the transport of the image receiving media substrates exiting the output of the image receiving media substrate processing device including controlling operation of the at least one auger motor, a configuration of the compiler tray and the planar top surfaces of the pair of auger components providing that the set of processed image receiving media substrates is supported in a first position in which the set of processed image receiving media substrates are partially supported by the compiler tray and the planar top surfaces of the pair of auger components.

10. The device of claim 9, the image receiving media substrate transport controller being programmed to operate the pair of auger components to urge lowermost processed image receiving media substrates in a direction opposite to the process direction facilitating alignment of the collected set of processed image receiving media substrates against an alignment surface associated with the image receiving media substrate processing device.

11. The device of claim 9, the image receiving media substrate transport controller being programmed to operate the pair of auger components to transport the collected set of processed image receiving media substrates from the first position to a second position in which the set of processed image receiving media substrates is substantially entirely supported on the planar top surfaces of the pair of auger components.

12. The device of claim 9, the image receiving media substrate transport controller being programmed to operate the pair of auger components to transport the collected set of processed image receiving media substrates from the second position to a third position in which the set of processed image receiving media substrates are transported vertically downward in the vertical compiler unit.

13. The device of claim 12, the image receiving media substrate transport controller being further programmed to:

receive signals regarding image processing in the image receiving media substrate processing device indicating completion of the set of processed image receiving media substrates collected in the compiler tray; and cause the at least one auger motor to operate to move the set of processed image receiving media substrates from the first position to the second position.

14. The device of claim 12, the image receiving media substrate transport controller being further programmed to cause the at least one auger motor to operate to move the set of processed image receiving media substrates from the second position to the third position lower in the vertical compiler unit leaving the planar top surfaces of the auger components open to receive another set of processed image receiving media substrates in the first position.

15. The device of claim 12, the third position being an exit position from the vertical compiler unit from which the set of processed image receiving media substrates is deposited on an internal media handling tray in a vicinity of the exit position.

16. A system for processing image receiving media substrates, comprising:

at least one of an image receiving media substrate processing and post-processing device that executes one of substrate pre-processing, substrate conditioning, substrate marking, image fusing and document finishing;

a compiler tray positioned at an output of the at least one of the image receiving media substrate processing and post-processing device as a first portion of a transport mechanism for collecting a set of processed image receiving media substrates exiting the output of the at least one of the image receiving media substrate processing and post-processing device;

a vertical compiler unit downstream of the compiler tray in a process direction as a second portion of the transport mechanism for moving collected sets of processed image receiving media substrates from the compiler tray, the vertical compiler unit comprising:

a pair of auger components as transport mechanisms in the vertical compiler unit, each of the pair of auger components having a planar top surface that is substantially parallel to, and positioned substantially coplanar with, the a substrate collection surface of the compiler tray, and at least one auger motor for driving the pair of auger components in a coordinated manner about respective vertical auger component shafts for the pair of auger components; and an image receiving media substrate transport controller that controls movement of the transport of the image receiving media substrates exiting the output of the at least one of the image receiving media substrate processing and post-processing device including controlling operation of the at least one auger motor, a configuration of the compiler tray and the planar top surfaces of the pair of auger components providing that the set of processed image receiving media substrates is supported in a first position in which the set of processed image receiving media substrates are partially supported by the compiler tray and the planar top surfaces of the pair of auger components.

17. The system of claim 16, the image receiving media substrate transport controller being programmed to:

receive image forming signals;

operate the pair of auger components to urge lowermost processed image receiving media substrates in a direction opposite to the process direction facilitating alignment of the collected set of processed image receiving media substrates against an alignment surface associated with the at least one of the image receiving media substrate processing and post-processing device;

operate the pair of auger components to transport the collected set of processed image receiving media substrates from the first position to a second position in which the set of processed image receiving media substrates is substantially entirely supported on the planar top surfaces of the pair of auger components;

operate the pair of auger components to transport the collected set of processed image receiving media substrates from the second position to a third position in which the set of processed image receiving media substrates are transported vertically downward in the vertical compiler unit.

18. The system of claim 16, the third position being an exit position from the vertical compiler unit from which the set of processed image receiving media substrates is deposited on an internal media handling tray in a vicinity of the exit position.

* * * * *